US007900916B2

(12) United States Patent
Sugahara et al.

(10) Patent No.: US 7,900,916 B2
(45) Date of Patent: Mar. 8, 2011

(54) PAPER SHEET TRANSPORT MECHANISM AND PAPER HANDLING DEVICE

(75) Inventors: Toshifumi Sugahara, Seto (JP); Naofumi Kitagawa, Seto (JP); Hiroshi Aoi, Owariasahi (JP); Shinji Shibata, Nagoya (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 92 days.

(21) Appl. No.: 12/323,720

(22) Filed: Nov. 26, 2008

(65) Prior Publication Data

US 2009/0212493 A1 Aug. 27, 2009

(30) Foreign Application Priority Data

Feb. 26, 2008 (JP) ..... 2008-044387

(51) Int. Cl.
*B65H 5/00* (2006.01)

(52) U.S. Cl. ..... 271/264; 271/207; 902/9

(58) Field of Classification Search ..... 271/264, 271/207, 164, 306, 198; 902/9, 15, 17; 109/45; 232/43.2

See application file for complete search history.

(56) References Cited

U.S. PATENT DOCUMENTS 6,695,307 B2 * 2/2004 Kanagawa ..... 271/207

FOREIGN PATENT DOCUMENTS

JP 2002-163704 6/2002

* cited by examiner

*Primary Examiner* — Kaitlin S Joerger

(74) *Attorney, Agent, or Firm* — Antonelli, Terry, Stout & Kraus, LLP.

(57) ABSTRACT

The first aspect of the present invention is a paper sheet transport mechanism. This mechanism comprises a first paper sheet guide that forms a first paper sheet transport path, the first paper sheet guide having a rotating shaft; a pushing unit that pushes the first paper sheet guide in a specified direction around the rotating shaft; a projecting member that moves in conjunction with movement of the first paper sheet guide; a second paper sheet guide that forms a second paper sheet transport path such that paper sheets are transferred between the first and second paper sheet guides; and a alignment unit that moves in conjunction with a retune movement of the second paper sheet guide to be in contact with the projecting member against the pushing by the pushing unit and to align one end of the first paper sheet guide and one end of the second paper sheet guide.

4 Claims, 12 Drawing Sheets

PAPER SHEET TRANSPORT MECHANISM AND PAPER HANDLING DEVICE

CROSS REFERENCE TO RELATED APPLICATIONS

The present invention claims priority from Japanese Application No. 2008-044387 filed on Feb. 26, 2008, the content of which is hereby incorporated by reference into this application.

BACKGROUND OF THE INVENTION

The present invention relates to a paper sheet handling device, and particularly to a paper sheet transport mechanism.

A paper sheet handling device typically includes an upper unit for storing a paper sheet receiving/dispensing mechanism, and a lower unit for storing a paper sheet storage box. The paper sheet receiving/dispensing mechanism and the paper sheet storage box are linked by a paper sheet transport path. Typically, when doing maintenance of the paper sheet handling device, the staff member displaces the upper unit to perform maintenance, and after maintenance has ended, returns the upper unit to its original position and fixes it.

However, after maintenance, when the staff member fixes the upper unit at its original position, there are cases when the upper unit ends up being fixed in a state with the upper unit and the lower unit displaced. Also, because it is possible to move the upper unit in relation to the lower unit, even if the staff member fixes the upper unit in the proper position, there are cases when the upper unit becomes displaced after that. In these cases, the paper sheet transport path that connects the paper sheet receiving/dispensing mechanism and the paper sheet storage box is also displaced, and there was the problem that the paper sheets became jammed.

SUMMARY OF THE INVENTION

An object of the present invention is retain the paper sheet transport path so as to be able to transport the paper sheets without paper jamming even when the unit is displaced.

To address at least part of the problems noted above, the present invention has the following modes.

The first aspect of the present invention is a paper sheet transport mechanism. This mechanism comprises a first paper sheet guide that forms a first paper sheet transport path, the first paper sheet guide having a rotating shaft; a pushing unit that pushes the first paper sheet guide in a specified direction around the rotating shaft; a projecting member that moves in conjunction with movement of the first paper sheet guide; a second paper sheet guide that forms a second paper sheet transport path such that paper sheets are transferred between the first and second paper sheet guides; and a alignment unit that moves in conjunction with a return movement of the second paper sheet guide to be in contact with the projecting member against the pushing by the pushing unit and to align one end of the first paper sheet guide and one end of the second paper sheet guide. With this aspect, one end of the first paper sheet guide and one end of the second paper sheet guide are aligned by the pushing unit and the alignment unit, so it is possible to retain a paper sheet transport path that is able to transport paper sheets without jamming.

With the first aspect, it is also possible to have the first paper sheet guide be an integrated body with the projecting member. With this aspect, the first paper sheet guide receives resistance force to the pushing force when the projecting member is in contact with the alignment unit, and aligns one end of the first paper sheet guide and one end of the second paper sheet guide.

With the first aspect of the present invention, it is also possible to have it so that the first paper sheet guide includes guide members that sandwich a paper sheet; and the projecting member holds a gap of the first paper sheet transport path at a fixed level or greater. With this aspect, it is possible to reduce the number of structural parts.

The first aspect of the present invention can also further comprise a gap holding unit that holds a gap of the first paper sheet transport path at a fixed level. It is also possible to equip a gap holding unit other than the projecting member.

With the first aspect of the present invention, it is also possible to have the second paper sheet guide includes guide members that sandwich the paper sheet; and the aliment unit and one surface of the second paper sheet guide are present on an identical plane. With this aspect, the aliment unit and one of both surfaces of the second paper sheet guide are present on an identical plane, so it is possible to align one end of the first paper sheet guide and one end of the second paper sheet guide.

With the first aspect of the present invention, it is also possible to have the alignment unit have an integrated constitution with the second paper sheet guide. With this aspect, it is possible to reduce the number of parts.

The second aspect of the present invention is a paper sheet handling device. This aspect comprises a first unit that houses a paper sheet storage box for storing paper sheets; a second unit that houses a paper sheet receiving/dispensing processing mechanism for performing paper sheet receiving and dispensing processing of paper sheets, the second unit being movable in a specified direction during maintenance; and a paper sheet transport mechanism according to any one of first aspects arranged at a junction between the first unit and the second unit. With this aspect, when returning the second unit to its original position after maintenance, even if the first unit and the second unit are displaced, it is possible to transfer paper sheets between the paper sheet storage box and the paper sheet receiving and dispensing processing mechanism without the paper sheets jamming.

Note that the present invention can be realized in various aspects, and for example, can be realized in a aspect such as a paper sheet transport mechanism, a paper sheet transport method, paper sheet handling, and the like.

BRIEF DESCRIPTION OF THE DRAWINGS

Preferred embodiments of the present invention will be described in conjunction with the accompanying drawings, in which.

DESCRIPTION OF THE PREFERRED EMBODIMENTS

Figure 1:
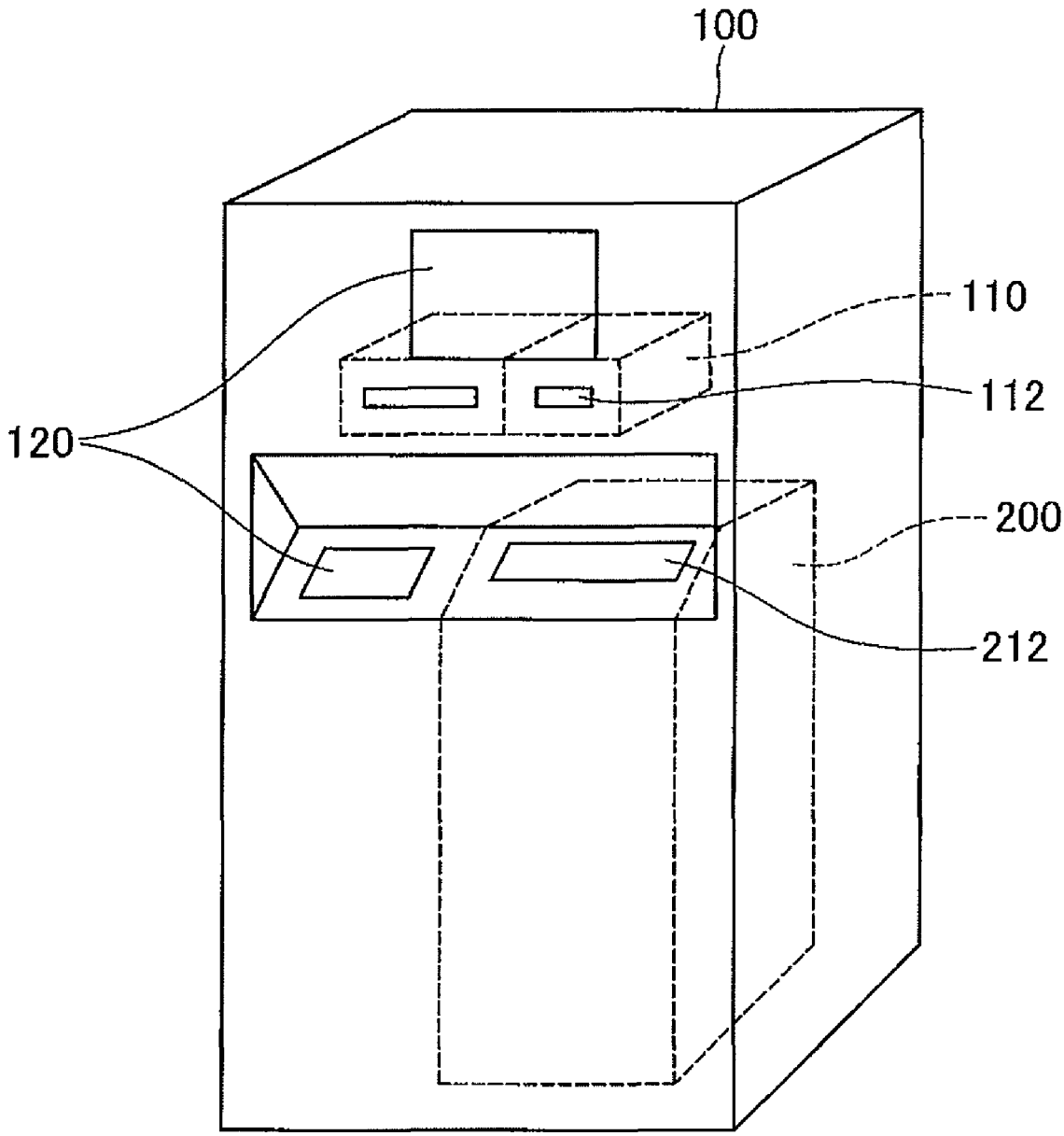
FIG. 1 is a perspective view showing the external appearance of an automatic teller machine of this embodiment.

Following, we will describe an embodiment of the present invention using the drawings. FIG. 1 is a perspective view showing the external appearance of an automatic teller machine of this embodiment. The automatic teller machine 100 uses a medium such as a card, a paper sheet money (hereafter called "paper sheet"), a passbook and performs processing with the user such as deposits, payments, transfers. The automatic teller machine 100 has a card and account statement processing mechanism 110, a customer operating unit 120, and a paper sheet handling mechanism 200. The card and account statement processing mechanism 110 is arranged on the top of the automatic teller machine 100. The card and account statement processing mechanism 110 has a card slot 112. The card and account statement processing mechanism 110 performs, for example, reading of data from the user's card, and printing of the passbook and transaction statement. The customer operating unit 120 has a display unit for displaying the transaction contents with the customer, and an input unit for receiving operations from the customer. The paper sheet handling mechanism 200 performs, for example, determination and storage of paper sheets input from the user, and dispensing of paper sheets to the user. The paper sheet handling mechanism 200 has a shutter 212.

Figure 2:
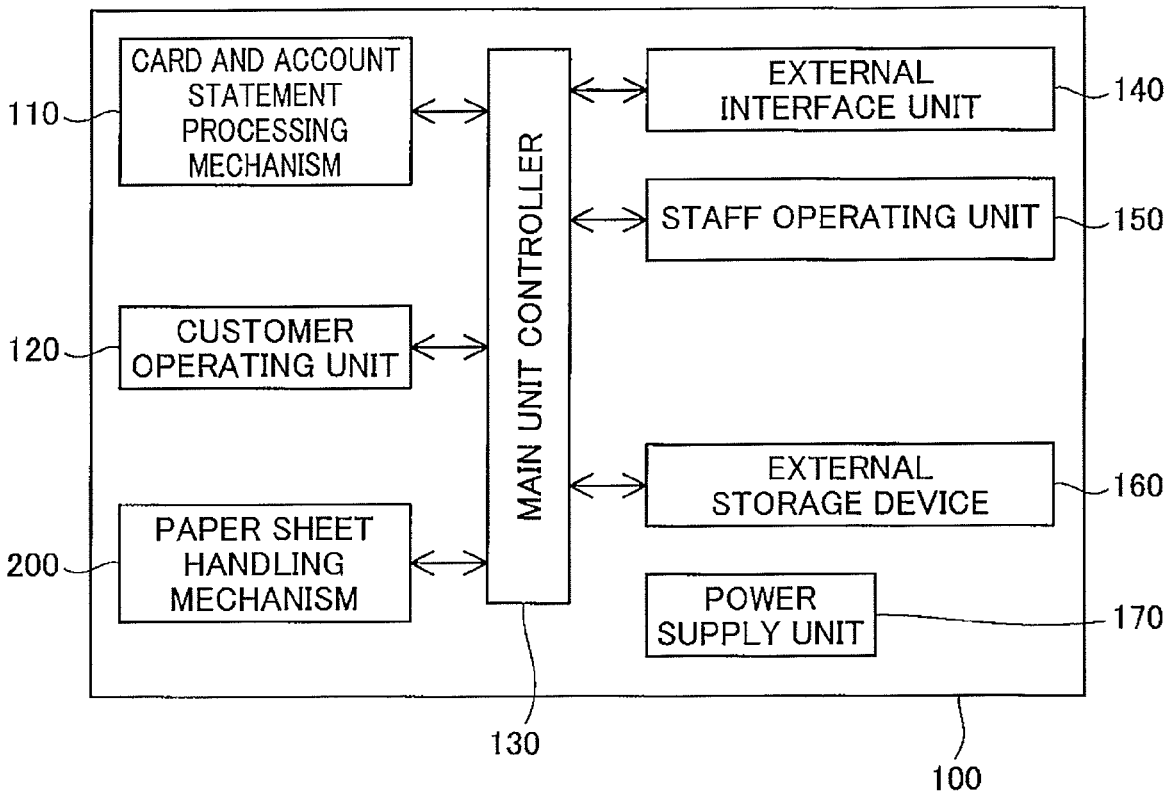
FIG. 2 is a control block diagram showing the control relationship of the automatic teller machine.

FIG. 2 is a control block diagram showing the control relationship of the automatic teller machine 100. The automatic teller machine 100 has a main unit controller 130, an external interface unit 140, a staff operating unit 150, an external storage device 160, and a power supply unit 170. The main unit controller 130 and the card and account statement processing mechanism 110, the customer operating unit 120, the paper sheet handling mechanism 200, the external interface unit 140, the staff operating unit 150, and the external storage device 160 are connected by a bus, for example. The main unit controller 130 performs overall control of the automatic teller machine 100. The external interface unit 140 performs exchange of data with the outside computer (not illustrated). The staff operating unit 150 is operated by the staff member during maintenance, for example. The external storage device 160 stores data processed by the main unit controller 130. The power supply unit 170 supplies power to the card and account statement processing mechanism 110, the customer operating unit 120, the main unit controller 130, the external interface unit 140, the staff operating unit 150, the external storage device 160, and the paper sheet handling mechanism 200.

Figure 3:
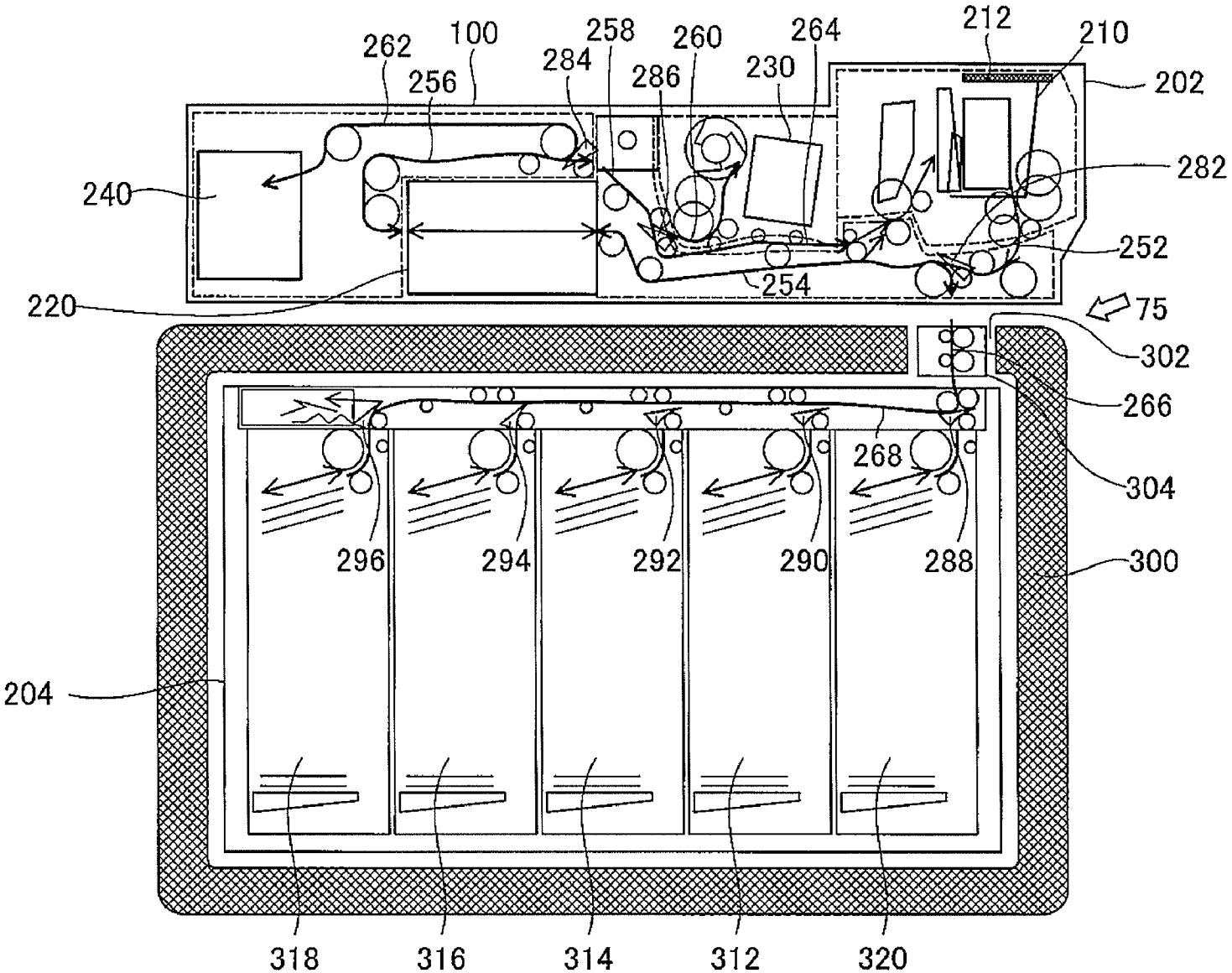
FIG. 3 is a transparent side view of the paper sheet handling mechanism.
Figure 4:
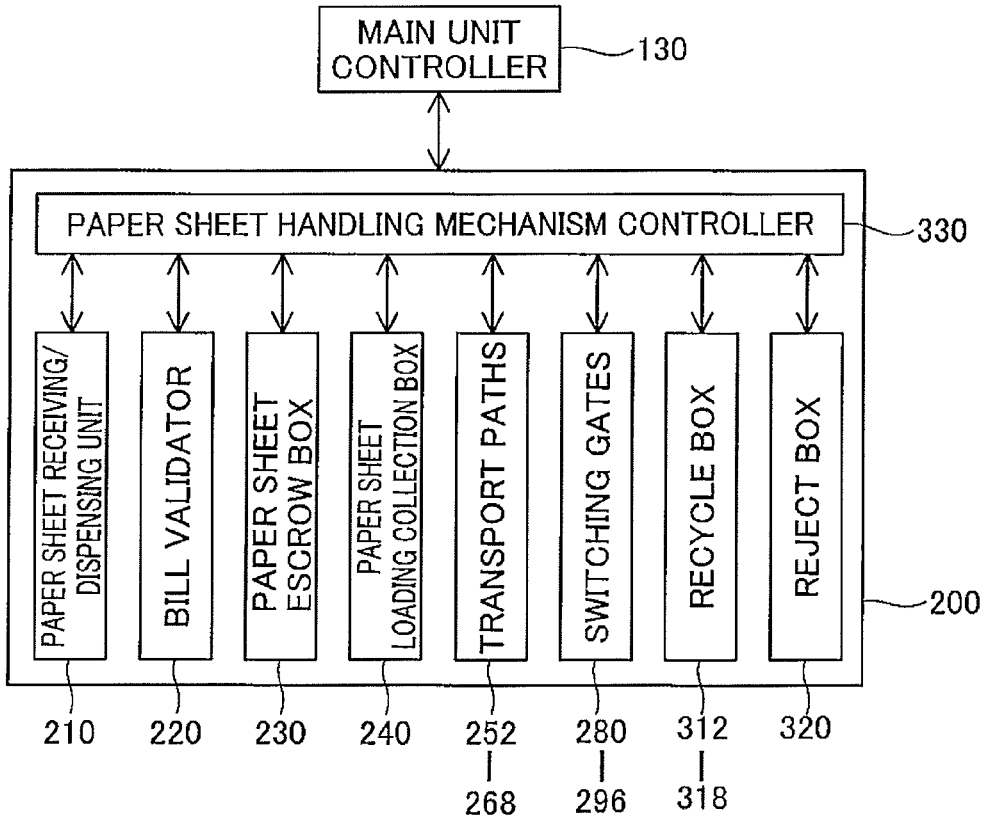
FIG. 4 is a control block diagram showing the control relationship of the paper sheet handling mechanism.

We will describe the paper sheet handling mechanism 200 using FIG. 3 and FIG. 4. FIG. 3 is a transparent side view of the paper sheet handling mechanism 200. FIG. 4 is a control block diagram showing the control relationship of the paper sheet handling mechanism 200. In FIG. 3, the right side of the drawing corresponds to the front side of the automatic teller machine 100, and the left side of the drawing corresponds to the back side. The paper sheet handling mechanism 200 has an upper paper sheet mechanism 202 and a lower paper sheet mechanism 204.

The upper paper sheet mechanism 202 has a paper sheet receiving/dispensing unit 210, a bill validator 220, a paper sheet escrow box 230, and a paper sheet loading collection box 240. With this embodiment, the paper sheet receiving/dispensing unit 210 is arranged at the farthest front of the upper paper sheet mechanism, the paper sheet escrow box 230 is arranged at the back part of the paper sheet receiving/dispensing unit 210, the bill validator 220 is arranged at the back part of the paper sheet escrow box 230, and the paper sheet loading collection box is arranged at the back part of the bill validator 220. The user, for example, inputs paper sheets to the paper sheet receiving/dispensing unit 210 when making a deposit or transfer, and takes paper sheets from the paper sheet receiving/dispensing unit 210 during dispensing. The shutter 212 noted above is arranged at the paper sheet receiving/dispensing unit 210. The shutter 212 opens when inputting or taking paper sheets. The bill validator 220 performs determination of the authenticity and face value of the paper sheet. The paper sheet escrow box 230 temporarily stores received paper sheets until the transaction is established. The paper sheet loading collection box 240 is used when loading paper sheets to the storage box of the lower paper sheet mechanism 204, or when collecting paper sheets from the storage box of the lower sheet paper mechanism 204.

The paper sheet receiving/dispensing unit 210 and the bill validator 220 are connected by the transport path 252 and the transport path 254. In the middle of the transport path 252 and the transport path 254 is provided a paper sheet switching gate 282 for allocating paper sheets to the lower paper sheet mechanism 204. The bill validator 220 and the paper sheet escrow box 230 are connected by the transport paths 256, 258, and 260. In the middle of the transport path 256 and the transport path 258 is provided the paper sheet switching gate 284 for allocating paper sheets to the paper sheet loading collection box 240 via the transport path 262. In the middle of the transport path 258 and the transport path 260 is provided a paper sheet switching gate 286 for allocating paper sheets to the paper sheet receiving/depositing unit 210 via the transport path 264. At the bottom of the paper sheet switching gate 282 is provided the transport path 266 for performing transfer of the paper sheets with the lower paper sheet mechanism 204. At least the transport paths 254, 256, 258, 260, 262, and 264 are bidirectional transport paths that can transport paper sheets in both directions forward and back.

The lower paper sheet mechanism 204 has recycle boxes 312 to 318 and reject box 320. The recycle boxes 312 to 318 store paper sheets by money denomination. The paper sheets stored in the recycle boxes 312 to 318 are provided for dispensing. The reject box 320 stores paper sheets which were deposited but not provided for dispensing. Whether or not paper sheets are provided for dispensing is based on the paper sheet face value and the paper sheet damage state.

The lower paper sheet mechanism 204 is enclosed by a cashbox 300. The top of the cashbox 300 has an opening part 302 opened in it. The opening part 302 has a linking part 304 arranged on it. The transport path 266 described above passes through the inside of the linking part 304. The transport path 266 is connected to the recycle boxes 312 to 318 and the reject box 320 via the transport path 268. The paper sheet switching gates 288 to 296 are arranged on the transport path 268, and allocate paper sheets to the recycle boxes 311 to 314 and the reject box 320. The transport paths 266 and 268 are bidirectional transport paths which are capable of transporting paper sheets in both forward and backward directions.

Using FIG. 4, we will describe the constitution of the control of the paper sheet handling mechanism 200. The paper sheet handling mechanism 200 has a paper sheet handling mechanism controller 330. The paper sheet handling mechanism controller 330 is connected to the main unit controller 130, receives instructions from the main unit controller 130, and controls the operation of the paper sheet receiving/dispensing unit 210, the bill validator 220, the paper sheet escrow box 230, transport path 252 to transport path 268, paper sheet switching gates 280 to 296, recycle boxes 312 to 318, and the reject box 320.

Next, we will describe the operation of the paper sheet handling mechanism 200.

First, we will describe the operation during receiving transaction processing. When paper sheets are inserted to the paper sheet receiving/dispensing unit 210, the paper sheet handling mechanism controller 330 transports them to the bill validator 220 using the transport paths 252 and 254. The paper sheet handling mechanism controller 330 uses sensors mounted in the bill validator 220 to determine the paper sheet authenticity, face value, and damage status, and sends the results to the main unit controller 130 via the paper sheet handling mechanism controller 330. The paper sheet handling mechanism controller 330 transports the paper sheets from the back part of the bill validator 220 to the paper sheet switching gate 284 using the transport path 256. The paper sheet handling mechanism controller 330 allocates paper sheets with the paper sheet switching gate 284 based on the results of the bill validator 220. The paper sheet handling mechanism controller 330 transports paper sheets determined to be acceptable to the paper sheet escrow box 230 using the transport paths 258 and 260, and transports paper sheets determined to be unrecognizable to the paper sheet receiving/dispensing unit 210 using the transport path 264. The main unit controller 130 displays the total value of the received paper sheets on the customer operating unit 120. When establishment of a receiving transaction is received from the customer through the customer operating unit 120, the paper sheet handling mechanism controller 330 receives instructions from the main unit controller 130, the paper sheets stored once in the paper sheet escrow box 230 are sent out in the reverse direction in the opposite sequence from the sequence when they were stored and pass through the bill validator 220. The paper sheet handling mechanism controller 330 changes the transport direction of the paper sheets to the transport path 266 direction using the paper sheet switching gate 282. The paper sheet handling mechanism controller 330 uses the transport path 268 and the paper sheet switching gates 288 to 296 to store the paper sheets in any of the recycle boxes 312 to 318 and the reject box 320. By doing this, the receiving transaction process is ended.

Next, we will describe the operation during dispensing transaction processing. When instructions to dispense a specified amount are received from the user, the main unit controller 130 gives instructions to the paper sheet handling mechanism controller 330 to transport the paper sheets to the paper sheet receiving/dispensing unit 210. The paper sheet handling mechanism controller 330 uses the bill validator 220 to determine the paper sheet authenticity, face value, and damage state. The paper sheet handling mechanism controller 330 allocates the paper sheets judged to be dispensable using the paper sheet switching gates 284 and 286, and transports them to the paper sheet receiving/dispensing unit 210, and allocates the paper sheets judged not to be dispensable to the transport path 262 direction using the paper sheet switching gate 284, and stores them in the paper sheet loading collection box 240. When the paper sheet transport operation ends, the main unit controller 130 opens the shutter 212, and makes it possible for the user to take the paper sheets. By doing this, the dispensing transaction process ends.

Figure 5:
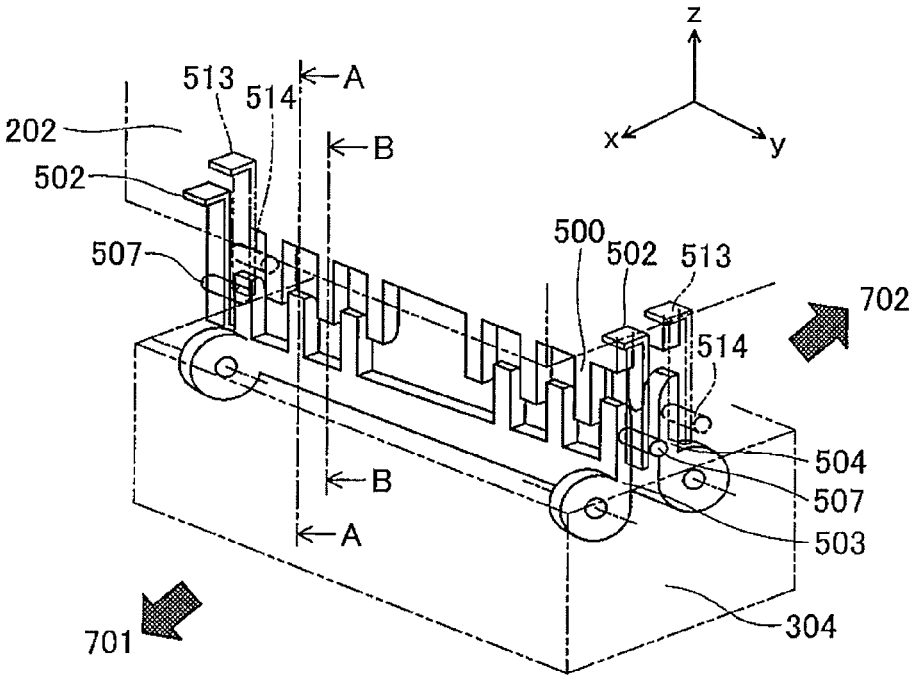
FIG. 5 is a perspective view near the linking part on the upper paper sheet mechanism side.
Figure 6:
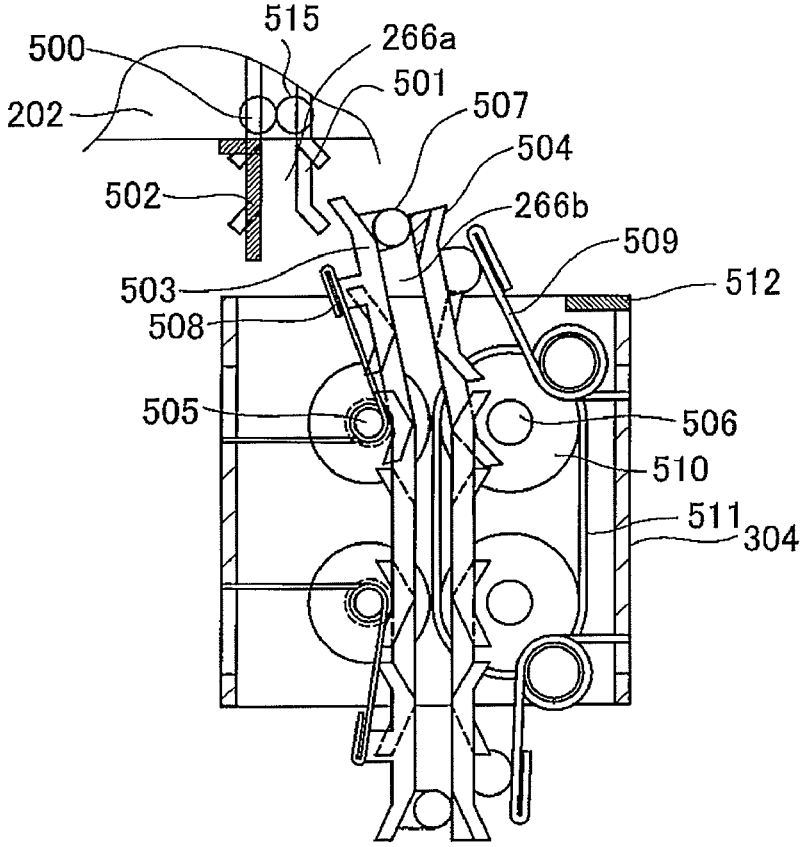
FIG. 6 is a transparent view near the linking part seen from the y axis direction of FIG. 5.
Figure 7:
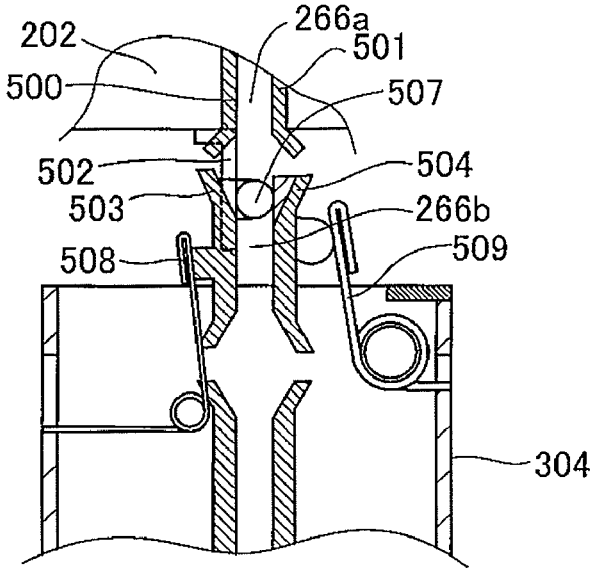
FIG. 7 is a drawing showing the A-A cross section of FIG. 5.
Figure 8:
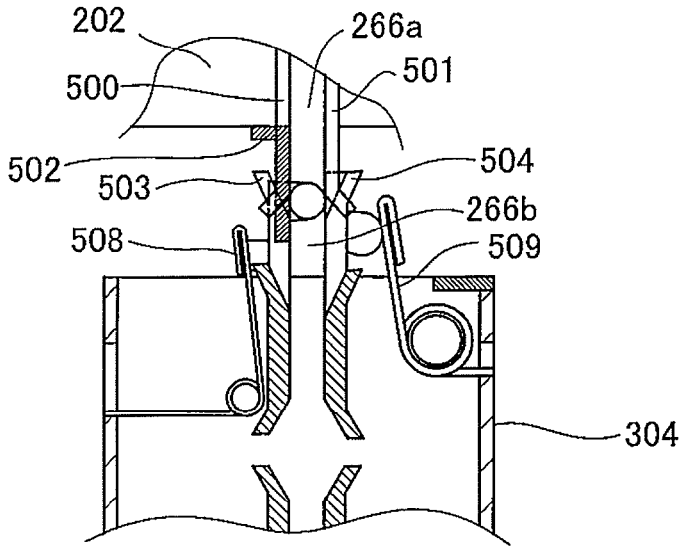
FIG. 8 is a drawing showing the B-B cross section of FIG. 5.

We will describe the constitution near the linking part 304 using FIG. 5 to FIG. 8. FIG. 5 is a perspective view near the linking part 304 on the upper paper sheet mechanism side. FIG. 6 is a transparent view near the linking part 304 seen from the y axis direction of FIG. 5. FIG. 7 is a drawing showing the A-A cross section of FIG. 5. FIG. 8 is a drawing showing the B-B cross section of FIG. 5. Note that FIG. 6 shows the state when the upper paper sheet mechanism 202 is pulled.

The upper paper sheet mechanism 202 has paper sheet guides 500 and 501, an alignment unit 502, and a roller 515. The paper sheet guide 500 and the paper sheet guide 501 are arranged with a specified gap open, and are a pair constituting part of the transport path 266 described above (hereafter referred to as "transport path 266*a*"). The paper sheet guides 500 and 501 tips form a comb shape. Note that in FIG. 6 through FIG. 8, the paper sheet guides 500 and 501 have a shape for which the tips are bent to the outside, but in FIG. 5, the shape of the tip bent to the outside is omitted. The alignment unit 502 is an L shaped member projecting from the upper paper sheet mechanism 202 to the linking part 304 side. The alignment unit 502 is adjacent to the paper sheet guide 500 and attached to the upper paper sheet mechanism 202 so that the surface formed by the projecting part and the surface that the paper sheet guide 500 forms become a flush surface. Note that the alignment unit 502 can also be attached to the paper sheet guide 500, and it is also possible for the alignment unit 502 and the paper sheet guide 500 to have an integrated constitution. The roller 515 transports the paper sheets.

The linking part 304 has paper sheet guides 503 and 504, springs 508 and 509, the roller 510, and a guide stopper 512. The paper sheet guide 503 and the paper sheet guide 504 are arranged with a specified gap open, these form a pair and constitute part of the transport path 266 (hereafter called "transport path 266*b*"). The paper sheet guides 503 and 504 have holes, and the rotating shafts 505 and 506 go through the holes. The rotating shafts 505 and 506 are fixed so that the paper sheet guides 503 and 504 can be rotated. The paper sheet guides 503 and 504 tips have comb shape. Note that in FIG. 6 through FIG. 8, the paper sheet guides 503 and 504 tips have a shape bent to the outside, but in FIG. 5, the tip shape bent to the outside is omitted. The paper sheet guide 503 has a projecting part 507 at the base paper sheet guide 504 side for which the tip bends to the outside. The projecting part 507 is in contact with the paper sheet guide 504, and keeps a fixed gap between the paper sheet guide 503 and the paper sheet guide 504. The spring 508 pushes the paper sheet guide 503 in the clockwise direction on the figure in FIG. 6. The spring 509 pushes the paper sheet guide 504 in the counterclockwise direction on the figure in FIG. 6. Note that with this embodiment, the elastic force of the spring 509 is stronger than the elastic force of the spring 508. The roller 510 drives the transport belt 511. Note that with this embodiment, the gripping force of the roller 510 that sandwiches the paper sheets is set to be weaker than the gripping force of the roller 515 that sandwiches the paper sheets. The transport belt 511 transports the paper sheets. The guide stopper 512 makes it so that the paper sheet guide 504 does not slant at a fixed level or greater in the clockwise direction.

Following, we will describe the state before maintenance of the linking part 304. Note that hereafter, the position of the upper paper sheet mechanism 202 before maintenance is called the "standard position." At the standard position, the paper sheet guide 504 is in contact with the projecting part 507, and the projecting part 507 is in contact with the alignment unit 502. In this state, the paper sheet guides 503 and 504 are pushed so as to turn from the spring 509 in the counterclockwise direction, but on the other hand, it receives force resistant to the push from the alignment unit 502 via the projecting part 507. Therefore, as described above, the paper sheet guide 504 is in contact with the projecting part 507, and the projecting part 507 is in a state in contact with the receiving unit. At this time, the alignment unit 502 and the paper sheet guide 500 form a flush surface, so the tip of the paper sheet guide 500 and the tip of the paper sheet guide 503, and the tip of the paper sheet guide 501 and the tip of the paper sheet guide 504 respectively exactly interlock with each other and are aligned.

Figure 9:
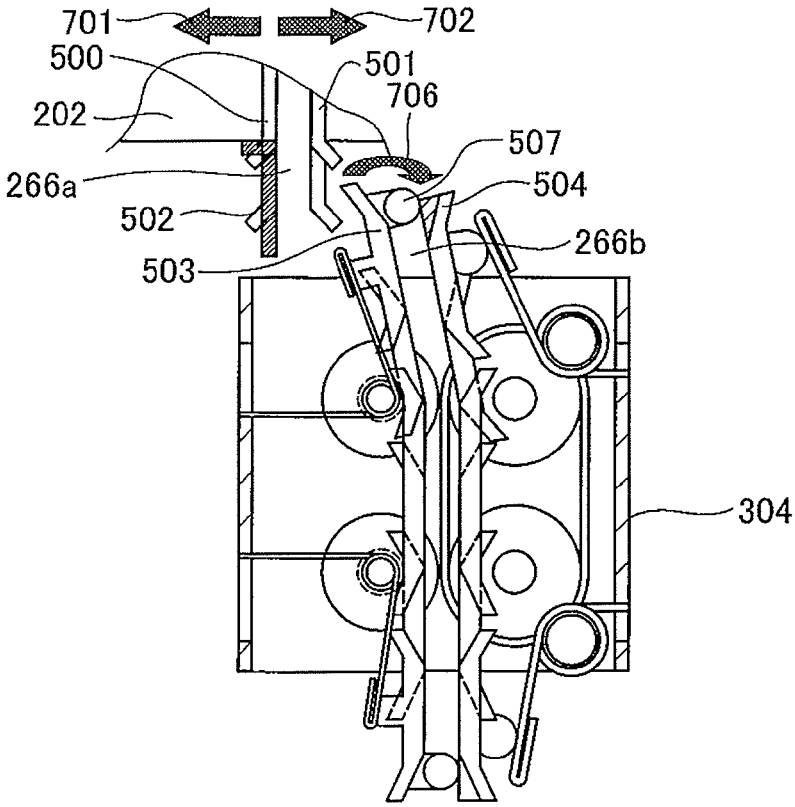
FIG. 9 is an explanatory drawing showing the state when the upper paper sheet mechanism is completely pulled in the arrow 701 direction.
Figure 10:
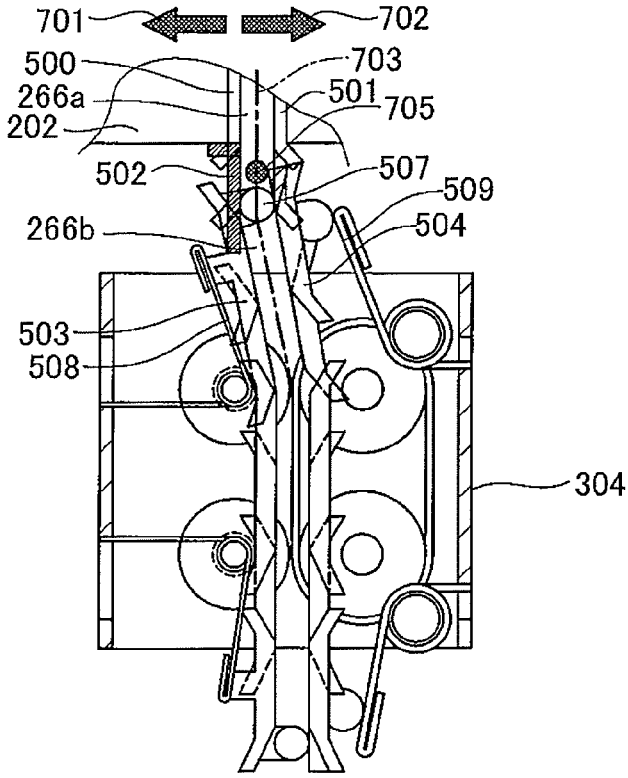
FIG. 10 is an explanatory drawing showing the state when the receiving unit and the projecting part are exactly in contact.
Figure 11:
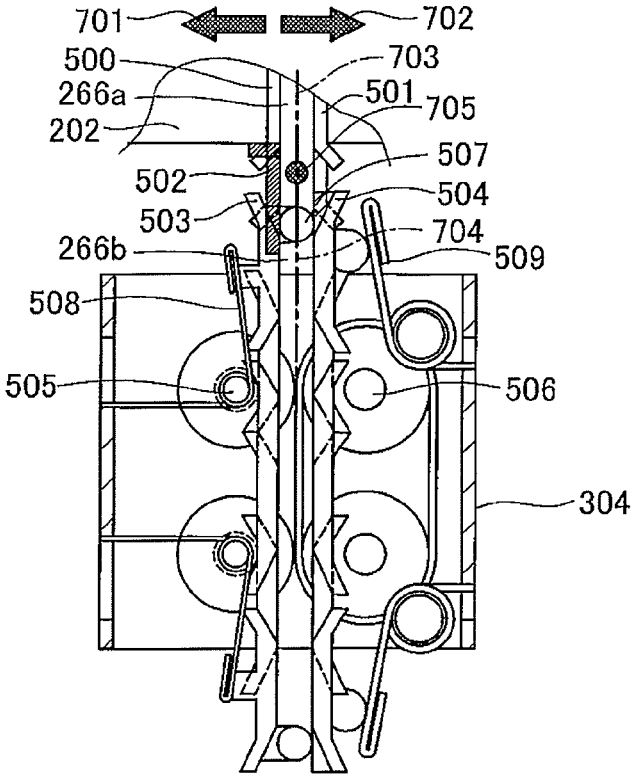
FIG. 11 is an explanatory drawing showing the state when the upper paper sheet mechanism is in the standard position.
Figure 12:
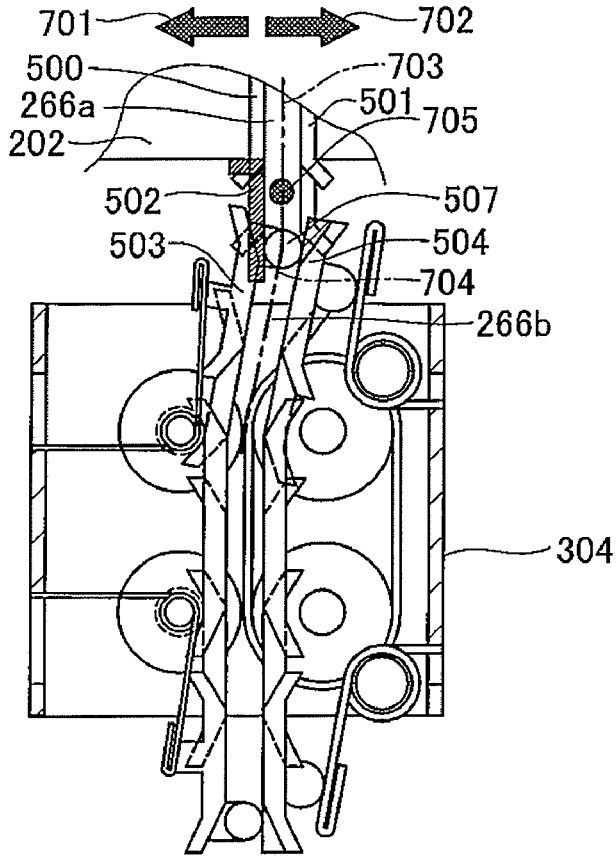
FIG. 12 is an explanatory drawing showing the state when the upper paper sheet mechanism goes past the standard position and moves in the arrow 702 direction.
Figure 13:
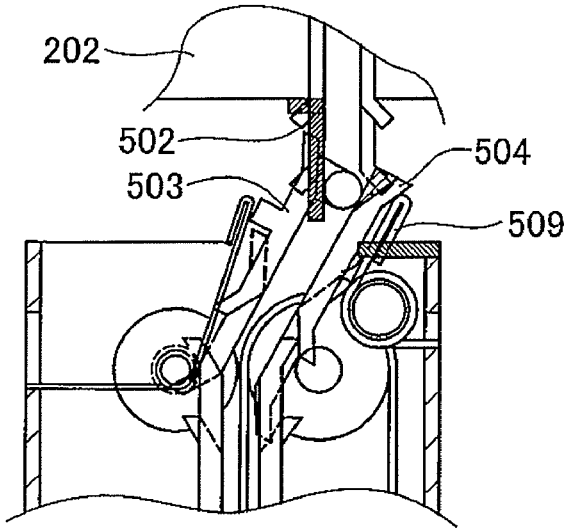
FIG. 13 is an explanatory drawing showing the state when the upper paper sheet mechanism is moved to the boundary in the arrow 702 direction.

Using FIG. 9 through FIG. 13, we will describe the operation when moving the upper paper sheet mechanism 202. FIG. 9 is an explanatory drawing showing the state when the upper paper sheet mechanism is completely pulled in the arrow 701 direction. FIG. 10 is an explanatory drawing showing the state when the receiving unit and the projecting part are exactly in contact. FIG. 11 is an explanatory drawing showing the state when the upper paper sheet mechanism is in the standard position. FIG. 12 is an explanatory drawing showing the state when the upper paper sheet mechanism goes past the standard position and moves in the arrow 702 direction. FIG. 13 is an explanatory drawing showing the state when the upper paper sheet mechanism is moved to the boundary in the arrow 702 direction.

Using FIG. 9, we will describe the state when the upper paper sheet mechanism 202 is completely pulled in the arrow 701 direction. As described above, the paper sheet guides 504 and 503 are pushed in the counterclockwise direction by the elastic force of the spring 509. Here, the alignment unit 502 moves in the arrow 701 direction together with the upper paper sheet mechanism 202, so even when the paper sheet guides 504 and 503 slant in the counterclockwise direction, the projecting part 507 does not contact the alignment unit 502. However, by the paper sheet guide 503 slanting in the counterclockwise direction, the spring 508 contracts and the elastic force becomes larger. Meanwhile, the spring 509 expands and the elastic force becomes smaller. Therefore, the paper sheet guides 504 and 503 are slanted until the position at which the elastic force of the spring 508 and the spring 509 balance out. Therefore, the position of the projecting part 507 is set. Here, the length of the alignment unit 502 linking part 304 direction is longer than the gap between the upper paper sheet mechanism 202 and the projecting part 507, so when the staff member returns the upper paper sheet mechanism 202 to the standard position, the alignment unit 502 is in contact with the projecting part 507, and it is possible to rotate the paper sheet guides 503 and 504 in the clockwise direction.

Using FIG. 10, we will describe the state when the upper paper sheet mechanism 202 moves from the state completely pulled out to the standard position direction, and the alignment unit 502 is exactly in contact with the projecting part 507. When the upper paper sheet mechanism 202 moves in the arrow 702 direction, the paper sheet guides 500 and 501 and the receiving unit also move in the arrow 702 direction. The alignment unit 502 is in contact with the projecting part 507. At this time, the alignment unit 502 and the paper sheet guide 500 form a flush surface, so the paper sheet guides 500 and 501 move to a position for which the tips align with the tips of the paper sheet guides 503 and 504. Therefore, the tips of the paper sheet guides 500 and 501 and the tips of the paper sheet guides 503 and 504 exactly interlock with each other. In this state, the center line 703 of the transport path 266*a* and the center line 704 of the transport path 266*b* are almost aligned at the transport opening 705. Specifically, the bottom edge part of the transport path 266*a* and the top edge part of the transport path 266*b* are exactly aligned, and transfer of paper sheets between the transport path 266*a* and the transport path 266*b* is performed smoothly.

After this, when the upper paper sheet mechanism 202 moves further in the arrow 702 direction, the paper sheet guides 500 and 501 move in the arrow 702 direction, but the alignment unit 502 also moves in the arrow 702 direction. The alignment unit 502 resists the pushing force by the spring 509 and presses the projecting part 507 in the arrow 702 direction, and the paper sheet guides 503 and 504 also rotate in the clockwise direction. As a result, the paper sheet guides 503 and 504 rotate by the amount that the paper sheet guides 500 and 501 moved, so the interlocking of the tips of the paper sheet guides 500 and 501 and the paper sheet guides 503 and 504 is maintained. Therefore, the smooth transfer of paper sheets between the transport path 266*a* and the transport path 266*b* is maintained.

Using FIG. 11, we will describe the state when the upper paper sheet mechanism 202 matches the standard position. Furthermore, when the upper paper sheet mechanism 202 moves in the arrow 702 direction, the upper paper sheet mechanism 202 reaches the standard position. This state is the same as the state before maintenance, the center line 703 of the transport path 266*a* and the center line 704 of the transport path 266*b* become a straight line, and make an ideal transport path connection.

Using FIG. 12, we will describe the state when the upper paper sheet mechanism 202 moves further in the arrow 702 direction from the standard position. When the upper paper sheet mechanism 202 goes past the standard position and moves in the arrow 702 direction, the paper sheet guides 500 and 501 and the alignment unit 502 also move in the arrow 702 direction. The projecting part 507 is moved further in the arrow 702 direction by the alignment unit 502, and the paper sheet guides 503 and 504 are further rotated in the clockwise direction. In this state as well, the interlocking of the tips of the paper sheet guides 500 and 501 and the tips of the paper sheet guides 503 and 504 is maintained, and the center line 703 of the transport path 266*a* and the center line 704 of the transport path 266*b* still almost match at the transport opening 705. Specifically, even when the upper paper sheet mechanism 202 goes past the standard position and moves in the arrow 702 direction, the bottom edge part of the transport path

266*a* and the upper edge part of the transport path 266*b* exactly align, and the transfer of paper sheets between the transport path 266*a* and the transport path 266*b* is performed smoothly.

Using FIG. 13, we will describe the state with which the upper paper sheet mechanism 202 is moved to the boundary in the arrow 702 direction. When the upper paper sheet mechanism 202 moves further in the arrow 702 direction, the paper sheet guide 504 comes up against the guide stopper 512. The paper sheet guide 504 receives the resistance force in the counterclockwise direction from the guide stopper 512, so the slanting is restricted so as not to slant in the clockwise direction at a fixed level or greater. As a result, the movement of the projecting part 507 in the arrow 702 direction is restricted. The movement of the alignment unit 502 in the arrow 702 direction is also restricted, and the movement of the upper paper sheet mechanism 202 in the arrow 702 direction is also restricted.

After maintenance, the staff member returns the upper paper sheet mechanism 202 to its original position and fixes it, but there are cases when it is displaced from the standard position. However, if the position of the upper paper sheet mechanism 202 is the position shown in FIG. 10 through FIG. 12, the tips of the paper sheet guides 500 and 501 and the tips of the paper sheet guides 503 and 504 are aligned and interlocked, so transfer of paper sheets between the transport path 266*a* and the transport path 266*b* is performed smoothly. Specifically, with this embodiment, after maintenance, when the staff member returns the upper paper sheet mechanism 202 to its original position, even if the position of the upper paper sheet mechanism 202 is slightly displaced from the standard position in the arrow 701 direction or the arrow 702 direction, the transfer of paper sheets between the transport path 266*a* and the transport path 266*b* is performed smoothly, and a suitable transport path is retained.

Note that when the staff member returns the upper paper sheet mechanism 202 to the standard position, the upper paper sheet mechanism 202 has a heavy weight, so with the standard position as the center, it moves alternately in the arrow 701 and the arrow 702 directions, and returns to the standard position while attenuating. Specifically, there are cases when the upper paper sheet mechanism 202 goes past the standard position and moves in the arrow 702 direction. Following, we will describe the operation when the upper paper sheet mechanism 202 goes from a state going past the standard position and moving in the arrow 702 direction to returning to the standard position. The upper paper sheet mechanism 202 moves in the arrow 701 direction. At this time, the paper sheet guides 500 and 501 and the receiving unit 502 also similarly move in the arrow 701 direction. When the alignment unit 502 moves in the arrow 701 direction, the projecting part 507 no longer receives the force resistant to the elastic force of the spring 509, so by the elastic force of the spring 509, it slants in the counterclockwise direction and the contact with the alignment unit 502 is maintained. The paper sheet guides 500 and 501 move in the arrow 701 direction, but because the paper sheet guides 503 and 504 rotate in the counterclockwise direction, the interlocking of the tips of the paper sheet guides 500 and 501 and the tips of the paper sheet guides 503 and 504 is maintained, and the center line 703 of the transport path 266*a* and the center line 704 of the transport path 266*b* are still almost aligned at the transport opening 705. Therefore, transfer of paper sheets between the transport path 266*a* and the transport path 266*b* is performed smoothly.

Figure 14:
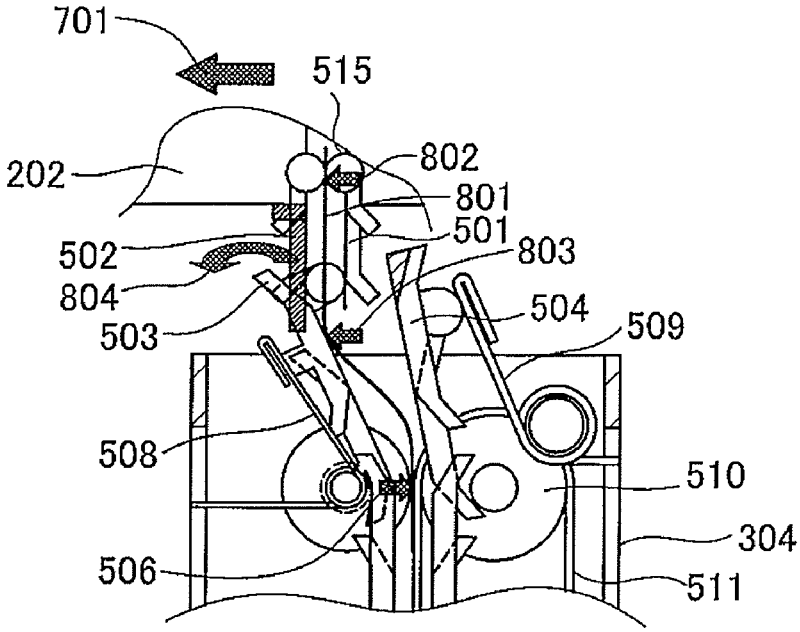
FIG. 14 is an explanatory drawing showing the state when starting to pull out the upper paper sheet mechanism.
Figure 15:
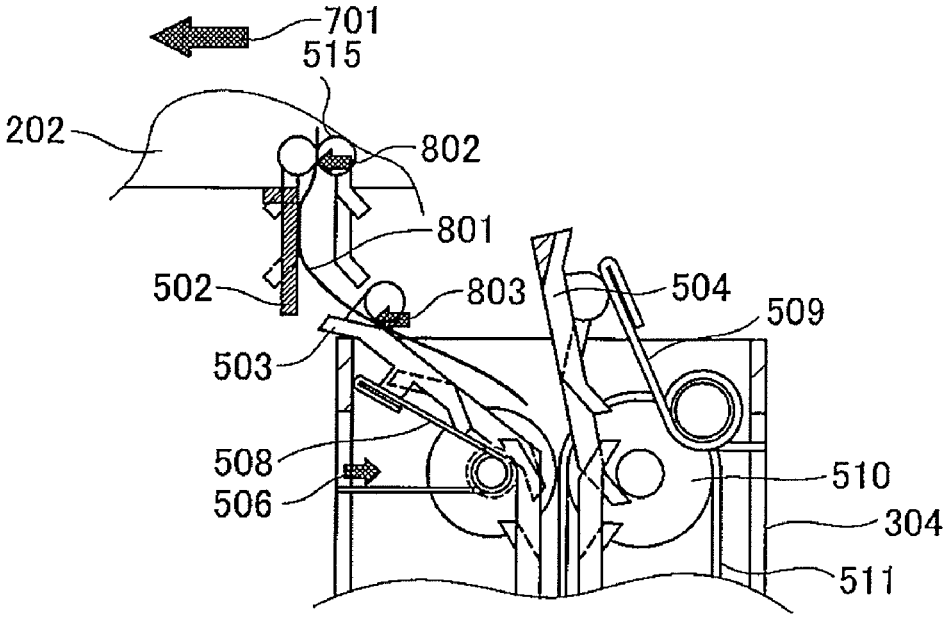
FIG. 15 is an explanatory drawing showing the state when midway of pulling out the upper part paper sheet mechanism.
Figure 16:
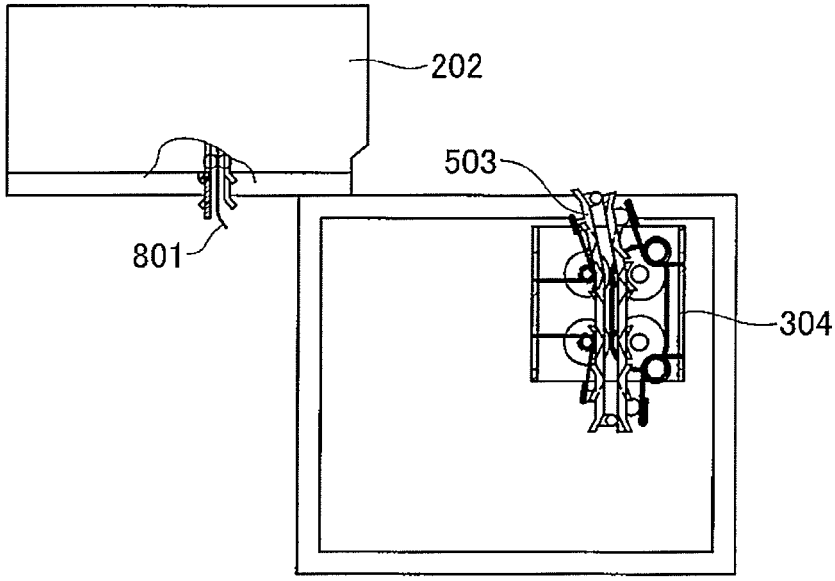
FIG. 16 is an explanatory drawing showing the state when pulling out of the upper paper sheet mechanism is completed.

Using FIG. 14 through FIG. 16, we will describe the jam removal process for cases when a jam occurs at the connection part of the upper paper sheet mechanism 202 and the linking part 304, and a paper sheet 801 remains. FIG. 14 is an explanatory drawing showing the state when starting to pull out the upper paper sheet mechanism 202. FIG. 15 is an explanatory drawing showing the state when midway of pulling out the upper part paper sheet mechanism 202. FIG. 16 is an explanatory drawing showing the state when pulling out of the upper paper sheet mechanism 202 is completed.

We will assume that a jam has occurred with the paper sheet 801 sandwiched in the roller 515 and the roller 510. To recover from the jam of the automatic teller machine 100, as shown in FIG. 14, the staff member pulls the upper paper sheet mechanism 202 from the standard position in the arrow 701 direction. At this time, the paper sheet 801 is sandwiched in the roller 515 by the gripping force 802, so the paper sheet 801 tries to move together with the upper paper sheet mechanism 202. Thus, the paper sheet guide 503 receives force from the paper sheet 801 in the arrow 803 direction, and slants in the arrow 804 direction. Here, the size of the elastic force of the spring 508 is a size that will not tear the paper sheet 801 and for which the paper sheet guide 503 slants when force is received from the paper sheet 801 in the arrow 803 direction.

As shown in FIG. 15, when the upper paper sheet mechanism 202 is further pulled out, the paper sheet guide 503 receives force from the paper sheet 801 to the arrow 803 direction, and slants up to the position at which at its maximum it bumps up against the back end of the linking part 304. Also, the gripping force 805 of the roller 510 is weaker than the gripping force 802 of the roller 515. So as shown in FIG. 16, the paper sheet 801 is pulled out together with the upper paper sheet mechanism 202. As a result, removing the remaining paper sheet 801 becomes easy. By doing this, there are fewer cases of the paper sheet 801 remaining in the linking part 304, so the jam removing function is improved. It is also possible to prevent damage to the paper sheet guide 503 by the remaining paper sheet 801.

As described above, with this embodiment, the paper sheet guides 503 and 504 are pushed by the spring 509, and the projecting part 507 provided on the paper sheet guide 503 receives resistance force that is against to the pushing force of the spring from the alignment unit 502, and the tips of the paper sheet guides 500 and 501 and the tips of the paper sheet guides 503 and 504 are aligned. As a result, it is possible to retain a suitable paper sheet transport path.

With this embodiment, when the upper paper sheet mechanism 202 moves, the paper sheet guides 500 and 501 and the alignment unit 502 move in conjunction with this movement of the upper paper sheet mechanism 202. When the projecting part 507 is moved by the alignment unit 502, the paper sheet guides 503 and 504 are rotated. Therefore, even when the position of the paper sheet guides 500 and 501 moves, it is possible to align the tips of the paper sheet guides 500 and 501 and the tips of the paper sheet guides 503 and 504.

With this embodiment, the paper sheet guide 503 has the projecting part 507, so it receives resistance force from the alignment unit 502 to the pushing force of the spring 509, and it is possible to align the tips of the paper sheet guides 500 and 501 and the tips of the paper sheet guides 503 and 504.

With this embodiment, the projecting part 507 is in contact with the paper sheet guide 504, and a fixed level gap is kept between the paper sheet guide 503 and the paper sheet guide 504. As a result, it is possible to convey pushing force applied to the paper sheet guide 504 to the paper sheet guide 503 or to convey resistance force applied to the paper sheet guide 503 to the paper sheet guide 504 with a small number of parts.

With this embodiment, the surface formed by the paper sheet guide 500 and the surface formed by the alignment unit 502 become a flush surface. As a result, when the alignment unit 502 is in contact with the projecting part 507, it is possible to align the tips of the paper sheet guides 500 and 501 and the tips of the paper sheet guides 503 and 504.

With the description above, we described a case of the upper paper sheet mechanism 202 being displaced when it is returned to the standard position, but there are also cases when the upper paper sheet mechanism 202 is properly returned to the standard position, but after that, during use of the automatic teller machine 100, the fixing of the upper paper sheet mechanism 202 becomes loose, and the upper paper sheet mechanism 202 is displaced from the standard position. In this case, when displaced in the arrow 701 direction, the paper sheet guides 503 and 504 slant in the counterclockwise direction due to the spring 509, and when displaced in the arrow 702 direction, the paper sheet guides 503 and 504 slant in the clockwise direction due to the alignment unit 502. So it is possible to align the tips of the paper sheet guides 500 and 501 and the tips of the paper sheet guides 503 and 504, and smooth transport of paper sheets is maintained.

Also, with this embodiment, the gripping force of the roller 510 is weaker than the gripping force of the roller 515, and the elastic force of the spring 508 has a power level that the power does not tear the paper sheet 801, and for which the paper sheet guide 503 slants when force is received from the paper sheet 801 in the arrow 803 direction. So even when a jam occurs with paper sheets remaining in the transport path connection part, it is possible to easily remove the jam without tearing that paper sheet and without damaging the guide.

VARIATION EXAMPLE

Figure 17:
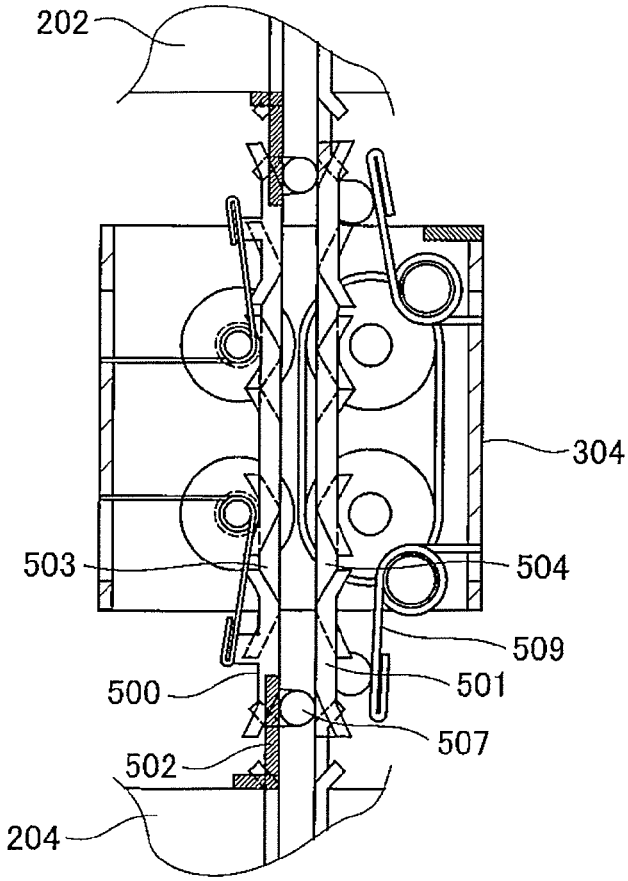
FIG. 17 is an explanatory drawing showing an example applying the constitution described with this embodiment to the constitution between the lower paper sheet mechanism and the linking part.
Figure 18:
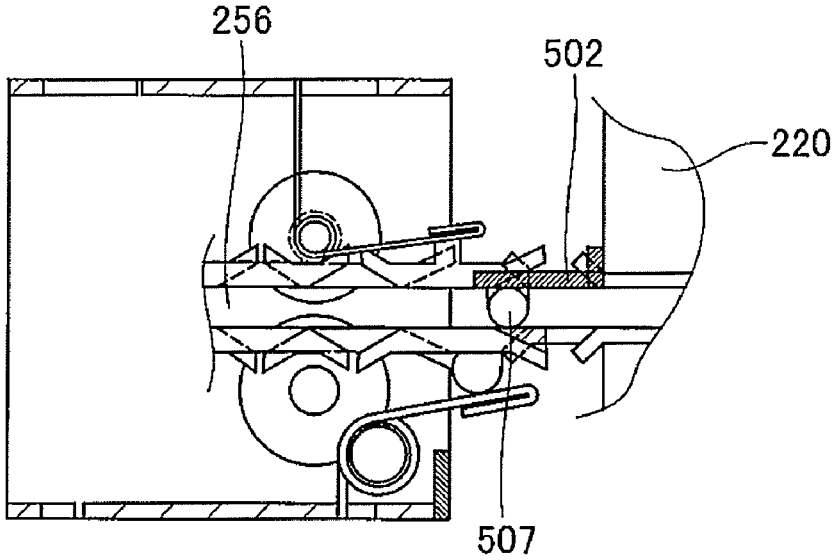
FIG. 18 is an explanatory drawing showing an example applying the constitution described with this embodiment to the constitution between the bill validator and the transport path.

Using FIG. 17 and FIG. 18, we will describe an application example at another position. FIG. 17 is an explanatory drawing showing an example applying the constitution described with this embodiment to the constitution between the lower paper sheet mechanism 204 and the linking part 304. FIG. 18 is an explanatory drawing showing an example applying the constitution described with this embodiment to the constitution between the bill validator 220 and the transport path 256. With the constitution described with this embodiment, this constitution may be used between the lower paper sheet mechanism 204 and the linking part 304, and is not limited to be used between the upper paper sheet mechanism 202 and the linking part 304. Also, the constitution described with this embodiment may also be used between each unit connected by transport paths. For example, as shown in FIG. 18, the constitution may be used between the bill validator 220 and the transport path 256. In this case, after the staff member removes the bill validator 220 for maintenance, when it is returned to its original position, smooth transfer of paper sheets between the bill validator 220 and the transport path 256 is maintained. The constitution described with this embodiment may be used between units constituting adjacent transport paths, or between adjacent units when one transport path is constituted from a plurality of units. In this case, after the staff member removes the unit and does transport path maintenance, when returning the unit to its original position, it is acceptable to not strictly align the unit position, so it is possible to do maintenance easily.

This embodiment has a constitution that the upper paper sheet mechanism 202 is pulled out in the arrow 701 direction of FIG. 5 during maintenance, so the alignment unit 502 is arranged adjacent to the paper sheet guide 500, and the projecting part 507 is equipped at the paper sheet guide 503. Conversely, the upper paper sheet mechanism 202 may be pulled out in the arrow 702 direction of FIG. 5 during maintenance. In this case, the upper paper sheet mechanism 202 may have a alignment unit 513 arranged adjacent to the paper sheet guide 501 instead of the alignment unit 502 and the paper sheet guide 504 may have a projecting part 514 instead of the projecting part 507. In this case, the elastic force of the spring 508 is made stronger than the elastic force of the spring 509.

With this embodiment, the upper paper sheet mechanism 202 has the paper sheet guides 500 and 501 and the alignment unit 502, and we described that the paper sheet guides 500 and 501 and the alignment unit 502 move, the upper paper sheet mechanism 202 may have the paper sheet guides 503 and 504 side, with the paper sheet guides 503 and 504 moving. In this case, the paper sheet guides 503 and 504 rotate together with parallel movement.

Figure 19:
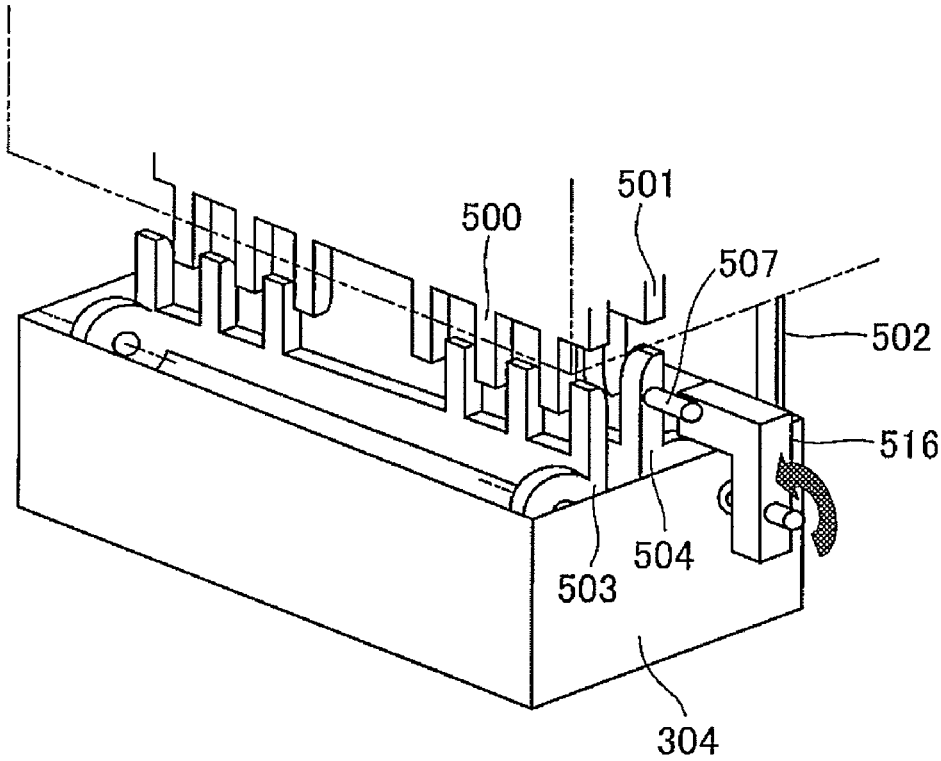
FIG. 19 is an explanatory drawing showing a variation example.

Note that as shown in FIG. 19, the linking part 304 may have the receiving unit 516. FIG. 19 is an explanatory drawing showing a variation example. With this constitution as well, it is possible to align the tips of the paper sheet guides 500 and 501 and the tips of the paper sheet guides 503 and 504.

Figure 20:
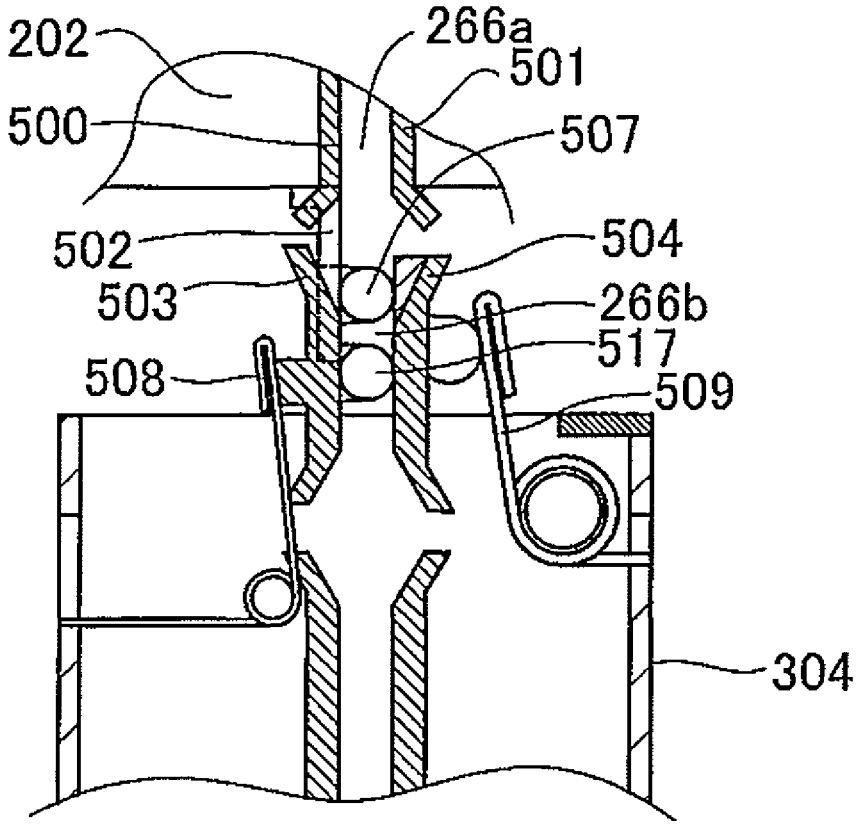
FIG. 20 is an explanatory drawing showing a variation example.

Note that in FIG. 20, the paper sheet guide 503 may have a gap holding unit 517 that holds at a fixed level the gap between the paper sheet guide 503 and the paper sheet guide 504 in addition to the projecting part 507. FIG. 20 is an explanatory drawing showing a variation example. With this constitution, the projecting part 507 is not used for holding the gap, so it can have any desired shape and arrangement.

With this embodiment, we described the paper sheet guide 500 and the paper sheet guide 501 as separate members, but these can also be an integrated unit. It is acceptable as long as it has the function of guiding so that the paper sheet is not displaced. With this embodiment, we described the paper sheet guide 500 and the alignment unit 502 as being separate, but it is also possible to have a constitution with the paper sheet guide 500 and the alignment unit 502 as an integrated unit. With this embodiment, we described the paper sheet guide 503 and the projecting part 507 as being separate, but it is also possible to have a constitution with the paper sheet guide 503 and the projecting part 507 as an integrated unit.

With this embodiment, the automatic teller machine 100 has the paper sheet handling mechanism controller 330 in addition to the main unit controller 130. But it is also possible to have a constitution for which the functions of the paper sheet handling mechanism controller 330 are executed by the main unit controller 130, and the ATM 10 do not have to have the paper sheet handling mechanism controller 330.

With this embodiment, we described an example of an automatic teller machine, but for example, it is also possible to have this be a teller apparatus. If the device has a paper sheet transport path, it is possible to use this mechanism for either device.

Above, we described modes of carrying out this invention based on several embodiments, but the aforementioned modes of carrying out the invention are for making the present invention easy to understand, and do not limit the present invention. The present invention can of course have modifications and improvements without straying from the key points and patent claims scope, and the present invention also includes equivalent items.

What is claimed is:

1. A paper sheet transport mechanism, comprising:

a first mechanism, including:

a pair of first paper sheet guide members that form a first paper sheet transport path used for transporting paper sheets, the first paper sheet guide members each having a rotating shaft;

a pushing unit that pushes each of the pair of first paper sheet guide members towards the other of the pair of first paper sheet guide members, in order to rotate the first paper sheet guide members around the rotating shafts;

a projecting member arranged between the pair of first paper sheet guide members, the projecting member being movable in conjunction with movement of one of the pair of first paper sheet guide members, the projecting member maintaining the pair of first paper sheet guide members in a substantially parallel relationship with each other along at least a portion of their length, with a fixed distance between them when rotating around the rotating shafts;

a second mechanism, including:

a pair of second paper sheet guide members that form a second paper sheet transport path used for transporting paper sheets such that paper sheets are transferred between the first and second paper sheet transport paths, the second paper sheet transport path being movable toward a substantially vertical direction of a surface of the second paper sheet guide members; and an alignment unit that moves in conjunction with a return movement of the second mechanism;

wherein the projecting member and the alignment unit contact each other at a position where the first paper sheet transport path is connected to the second paper sheet transport path;

wherein the second mechanism is movable such that the alignment unit pushes the projecting member to cause the pair of first paper guide members to move in parallel with each other along at least a portion of their length, while maintaining a passable connection between the first and second sheet transport paths; and wherein at least one of the pair of first paper sheet guide members is rotatable alone when an external force is applied to one of the pair of first paper sheet guide members against a pushing force of the pushing unit.

2. A paper sheet transport mechanism according to claim 1 wherein the projecting member is constituted as an integrated body with one of the pair of first paper sheet guide members.

3. A paper sheet transport mechanism according to claim 1, wherein the alignment unit has an integrated constitution with the second paper sheet guide members.

4. A paper sheet handling device, comprising:

a first unit that houses a paper sheet storage box for storing paper sheets;

a second unit that houses a paper sheet receiving/dispensing processing mechanism for performing paper sheet receiving and dispensing processing of paper sheets, the second unit being movable in a specified direction during maintenance; and a paper sheet transport mechanism according to any one of claims 1, 2, or 3 arranged at a junction between the first unit and the second unit, wherein the first unit includes the first mechanism, and the second unit includes the second mechanism.

* * * * *